US005472094A

United States Patent [19]

Szymocha et al.

[11] Patent Number: 5,472,094

[45] Date of Patent: Dec. 5, 1995

[54] FLOTATION MACHINE AND PROCESS FOR REMOVING IMPURITIES FROM COALS

[75] Inventors: Kazimierz Szymocha; Boleslaw Ignasiak; Wanda Pawlak, all of Edmonton, Canada; Conrad Kulik, Newark; Howard E. Lebowitz, Mountain View, both of Calif.

[73] Assignee: Electric Power Research Institute, Palo Alto, Calif.

[21] Appl. No.: 131,514

[22] Filed: Oct. 4, 1993

[51] Int. Cl.[6] ..... B03D 1/16

[52] U.S. Cl. ..... 209/169; 209/168

[58] Field of Search ..... 209/12.1, 168, 209/169, 725, 730

[56] References Cited

U.S. PATENT DOCUMENTS

| | | |
|---|---|---|
| 1,285,061 | 11/1918 | Daman . |
| 1,309,219 | 7/1919 | Ruth . |
| 1,312,754 | 8/1919 | Rowand . |
| 2,304,270 | 12/1942 | Mead . |
| 2,436,375 | 2/1948 | Booth . |
| 2,533,074 | 12/1950 | Weinig . |
| 3,351,195 | 11/1967 | Hukki . |
| 3,738,930 | 6/1973 | Kaminsky . |
| 3,739,910 | 6/1973 | Wilson . |
| 4,055,480 | 10/1977 | Smith . |
| 4,226,708 | 10/1980 | McCartney . |
| 4,290,886 | 9/1981 | Takakuwa . |
| 4,597,859 | 7/1986 | Beck . |
| 4,695,290 | 9/1987 | Kindig et al. . |
| 4,707,274 | 11/1987 | Donhauser et al. . |
| 4,747,939 | 5/1988 | Kampe . |
| 4,750,677 | 6/1988 | Taylor . |
| 4,750,994 | 6/1988 | Schneider . |
| 4,753,033 | 6/1988 | Kindig . |
| 4,776,950 | 10/1988 | Green et al. . |
| 4,871,447 | 10/1989 | Adamache . |
| 4,872,973 | 10/1989 | Ikebuchi et al. . |
| 4,887,722 | 12/1989 | Greenward, Sr. . |
| 4,892,648 | 1/1990 | Kulkarni . |
| 4,940,534 | 7/1990 | Harrison . |
| 4,964,576 | 10/1990 | Datta . |
| 4,966,608 | 10/1990 | Pawlak . |
| 5,039,400 | 8/1991 | Kallioinen . |
| 5,066,388 | 11/1991 | Ross . |
| 5,219,467 | 6/1993 | Nyman . |
| 5,234,112 | 8/1993 | Valenzuela . |

FOREIGN PATENT DOCUMENTS

| | | |
|---|---|---|
| 696758 | 10/1964 | Canada . |
| 638380 | 12/1978 | U.S.S.R. . |
| 899145 | 1/1982 | U.S.S.R. . |
| 1286295 | 1/1987 | U.S.S.R. . |

*Primary Examiner*—Thomas M. Lithgow
*Attorney, Agent, or Firm*—Fish & Richardson

[57] ABSTRACT

The present invention is directed to a type of flotation machine that combines three separate operations in a single unit. The flotation machine is a hydraulic separator that is capable of reducing the pyrite and other mineral matter content of a coal. When the hydraulic separator is used with a flotation system, the pyrite and certain other minerals particles that may have been entrained by hydrodynamic forces associated with conventional flotation machines and/or by the attachment forces associated with the formation of microagglomerates are washed and separated from the coal.

8 Claims, 4 Drawing Sheets

FLOTATION MACHINE AND PROCESS FOR REMOVING IMPURITIES FROM COALS

This Invention was made with U.S. Government support under Contract No. DE-FG22-87PC79865 awarded by the Department of Energy. The Government has certain rights in this invention.

The present invention is directed primarily to reducing the impurity content of the product stream from a flotation system using a novel flotation machine.

BACKGROUND OF THE INVENTION

Flotation systems are used in several industries as a primary method of separating a desirable component from waste components. The mineral processing, oil sands and environmental engineering industries, for example, all have major applications for flotation. The problem associated with all flotation systems, as a cleaning process, is the tendency for some fraction of the waste components to be transported into the product stream. Several different forces inherent in the flotation process and in machine designs are responsible for this occurrence, e.g., entrainment and entrapment.

Flotation machines can have different features and designs depending on their application. The flotation machine design used to float combustible solids, i.e., coal, is typically a rectangular or square shaped cell that has impeller assembly, including an agitator and aerator. A commonly used flotation machine design for coal is shown in FIG. 1.

This conventional flotation cell is designed to maximize the contact of air with a coal slurry. The cell 1 has a impeller assembly 2 that includes a standpipe 3. The lower portion 4 of the impeller assembly 2 act to draw slurry, water and air through the impeller. Air enters through inlet 7 and is drawn down into the cell 1 for mixing with a feed slurry. The slurry is introduced into the cell 1 via inlet 8. The impeller assembly 2 has a disperser 5 that is used to disperse the air into minute bubbles. The hydrophobic coal particles and/or microagglomerates attach to the bubbles and are levitated to the top of the cell forming a froth 6. The froth 6 is removed by mechanical means, such a skimmer.

Another type of flotation machine design is directed to column flotation. A typical design is shown in FIG. 2. Column flotation has received much attention in the past five years. The process is based on the principle of countercurrent flow of the impurity particles, i.e., the mineral matter, and coal particles.

Referring to FIG. 2, a flotation column 10 has a washing zone 11 and a collection zone 12. A feed inlet 13 introduces a coal slurry mixture into the column 10. Heavier mineral matter falls to the bottom of the column 10 due to gravity. Gas bubbles are formed by means 14. The coal particles attach to the gas bubbles and are floated to the top of column 10. A gentle spray of water from means 15 is used to wash the froth to liberate any entrained mineral matter.

Through the use of flotation, the sulphur and ash content of coal can be reduced, thereby improving its quality. However, due to similarities in surface chemistry characteristics, a small fraction of pyrite and certain other minerals will float together with the coal. As a result, accumulations of pyrite and other minerals in the collection zone and product stream of a flotation cell can be observed. Consequently, the separation efficiency for pyrite and certain other minerals will be limited.

The process disclosed in U.S. Pat. No. 4,966,608, incorporated by reference herein in its entirety, is capable of selectively forming microagglomerates of the combustible solids component of finely ground coal ($d_{50}$=150 μm). In this process, pyritic sulfur and certain other mineral rich particles may be transported into the product stream during flotation due to hydrodynamic forces, i.e., entrainment, and by these particles being attached to the microagglomerates, i.e. entrapment. Pyrite particles are often difficult to remove from the product stream and are a source of sulphur in coal that cause increased emission of sulphur compounds into the atmosphere when the coal is burnt. This contributes to the occurrence of acid rain.

The purity of the recovered product can be improved, as taught by the present invention, by sprinkling a flotation froth with water to wash the impurities and other loosely held particles from the froth. When processing coal, conventional flotation machine designs provide no areas for washing and settling of pyrite and other ash forming particles. The present invention is directed to a hydraulic separator that can be used as a second stage separator to improve the quality of most flotation product streams.

SUMMARY OF THE INVENTION

The present invention provides a hydraulic separator that combines at least three separate operations in a single unit. The hydraulic separator comprises a washing zone, a flotation zone and a settling zone in a compact, high throughput unit. The present hydraulic separator is a type of flotation machine. The hydraulic separator advantageously operates to remove the most difficult mineral particles from a flotation product stream by using a washing zone and a settling zone. After processing using the present invention, the quality of a product stream is improved.

The present invention is particularly directed to reducing the sulphur and mineral content of coal by creating hydrodynamic conditions for their separation from coal. Furthermore, the present machine design facilitates the detachment of pyrite and other mineral particles attached to the coal microagglomerates and permits their separation from the product stream.

These and other objects of the present invention will be apparent from the following description of the preferred embodiment and the appended claims.

DESCRIPTION OF THE PREFERRED EMBODIMENTS

In the treatment of coal, according to the present invention, the coal particles are first treated by a conventional flotation process, such as disclosed in U.S. Pat. No. 4,966,608, to form a flotation froth comprising coal particles (microagglomerates) and certain levels of pyrite and other mineral impurities. A variety of different coals can be treated, including bituminous and subbituminous coals. The froth is subsequently introduced into the hydraulic separator of the present invention.

The present invention will be described in terms of the preferred embodiment. As further described below, the hydraulic separator comprises at least three zones: a washing zone, a settling zone and a flotation zone. The design of the present invention requires that each zone to be in fluid communication with the other.

Figure 1:
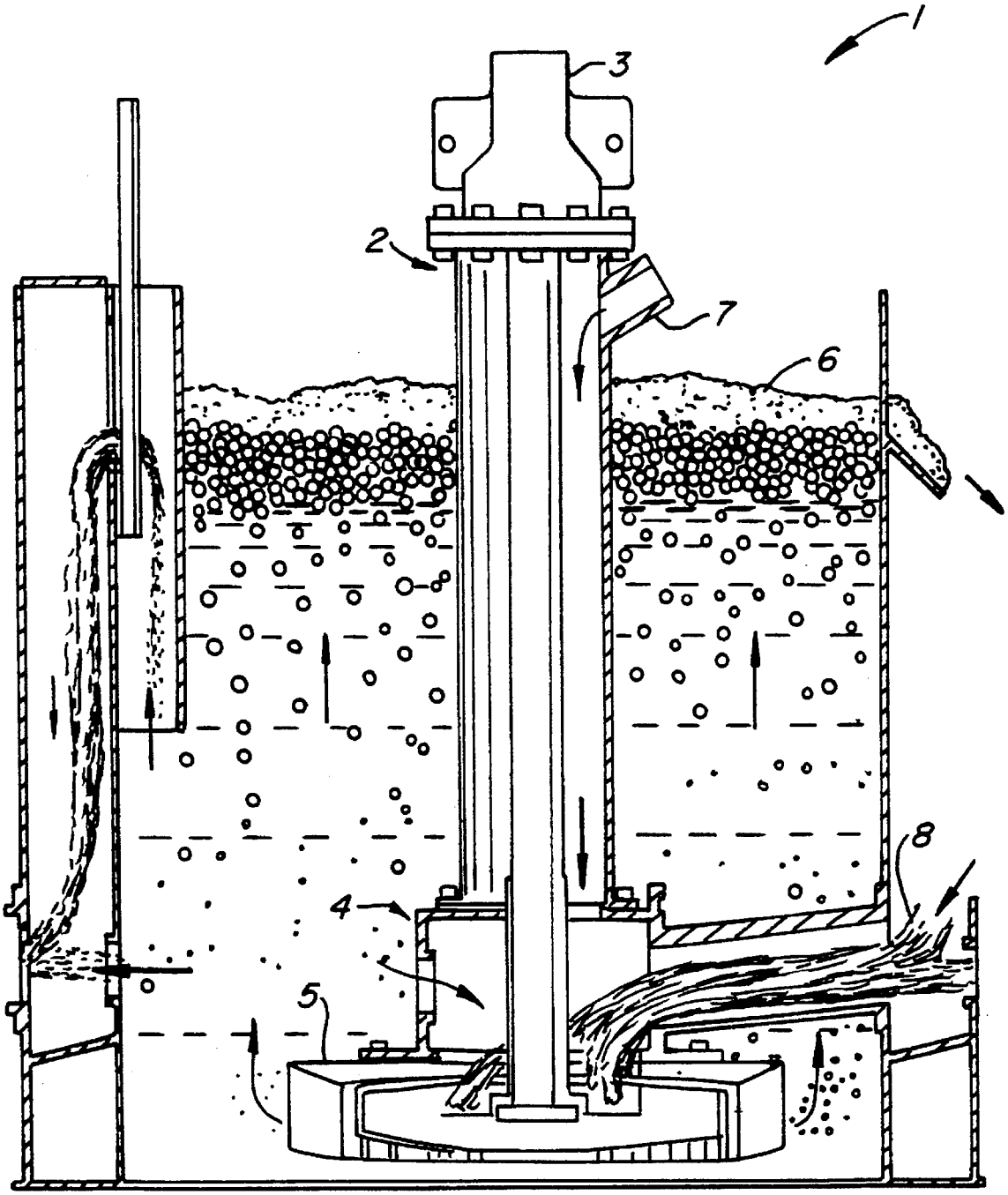
FIG. 1. PRIOR ART
FIG. 1 is a cross-sectional view of a flotation cell according to the prior art.
Figure 2:
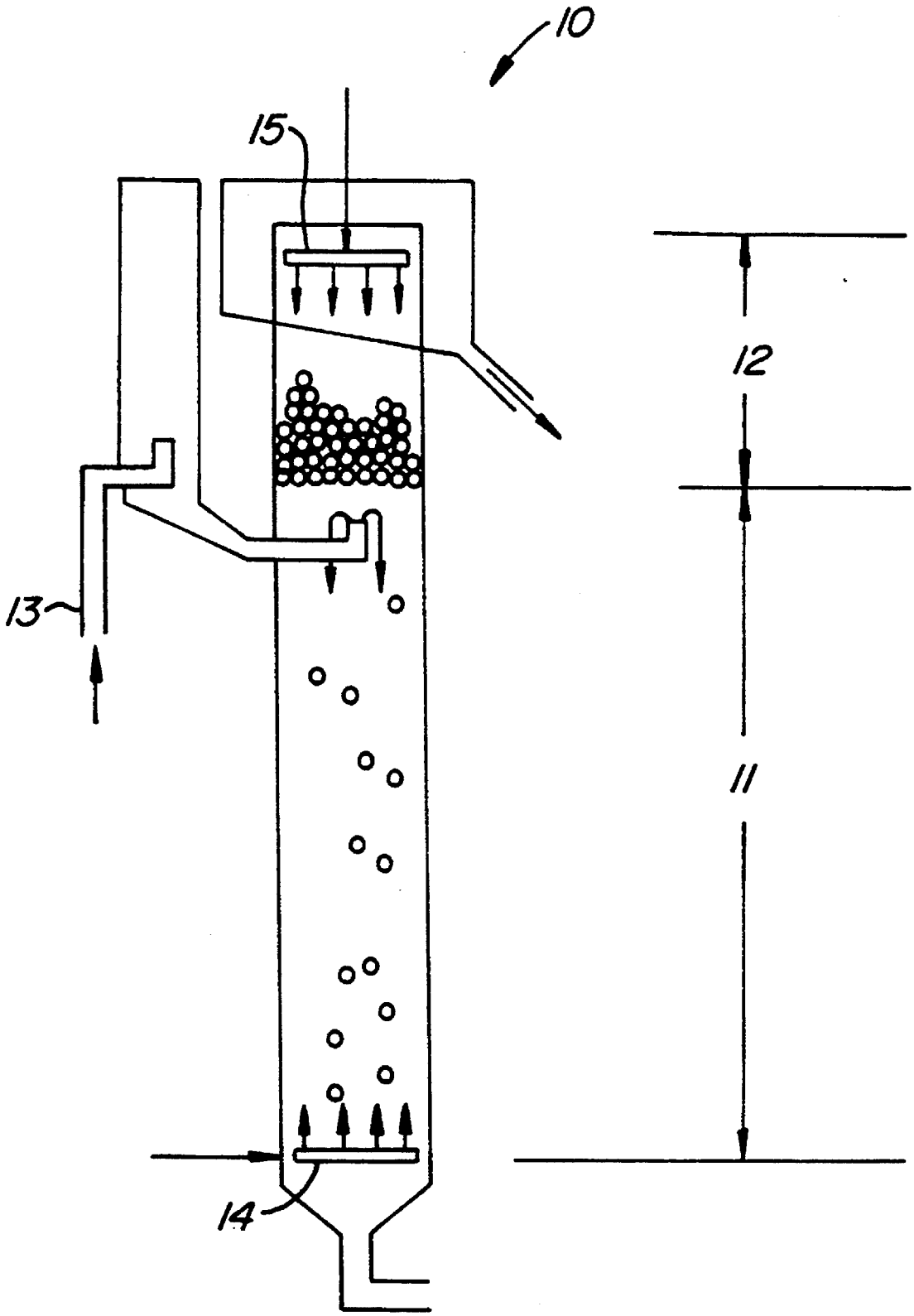
FIG. 2. PRIOR ART
FIG. 2 is a cross-sectional view of a flotation column according to the prior art.
Figure 3:
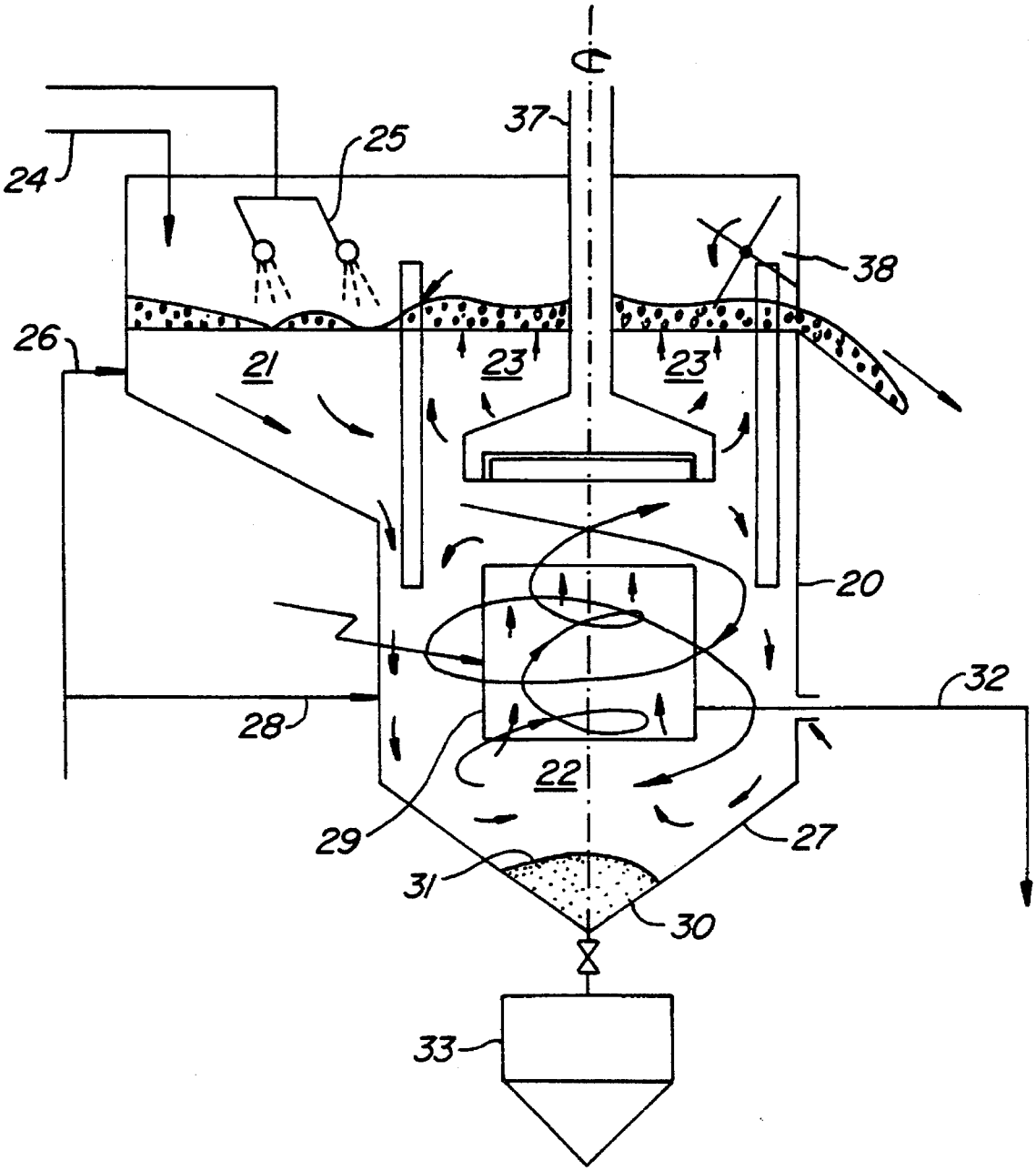
FIG. 3 is a cross-sectional view of a flotation machine according to the present invention.

Referring to the accompanying drawings, as shown in FIG. 3, the design of the preferred embodiment of the present invention is a single tank 20 configured to define washing, settling and flotation zones. The zones shown in FIG. 3 are representative of the configuration and are not drawn to scale. The zones are in fluid communication so that hydraulic flow patterns are created to separate the pyrite and mineral particles from the coal particles.

In washing zone 21, the feed stream 24 introduces a froth and/or slurry comprising suspended coal particles and/or microagglomerates, mineral particles and water into the zone. Water from washing means 25, preferably spray nozzles, is used to break down the froth and microagglomerates, thereby liberating any pyrite particles or other mineral matter entrained with the froth or entrapped in the microagglomerates or flocks formed during the flotation process. The water from washing means 25 is introduced at a high velocity that enables the water to penetrate the froth and the washing zone 21. The water penetrates to a depth in the range of 50 to 90% into the washing zone 21. It is preferred that the water from the washing means penetrate to a depth of about 80% into the washing zone 21.

Within the washing zone 21, the suspended feed particles, i.e., the microagglomerates or flocks and mineral particles, from the feed stream 24 are also met by a stream of wash water from an inlet 26. The inlet 26 directs the stream of water towards the settling zone 22 and the flotation zone 23, thereby facilitating the movement of the suspended feed particles. The suspended feed particles preferably have a minimum hydraulic retention time in the range of 0.5 to 2.5 minutes in the washing zone 21. The retention time will be varied according the characteristics of the coal being processed. The washing zone 21 has a bottom surface 27 that is sufficiently declined to facilitate the movement of any settled particles from the wash zone 21 to the settling zone 22. A minimum downward slope of 30° is preferred.

Figure 4:
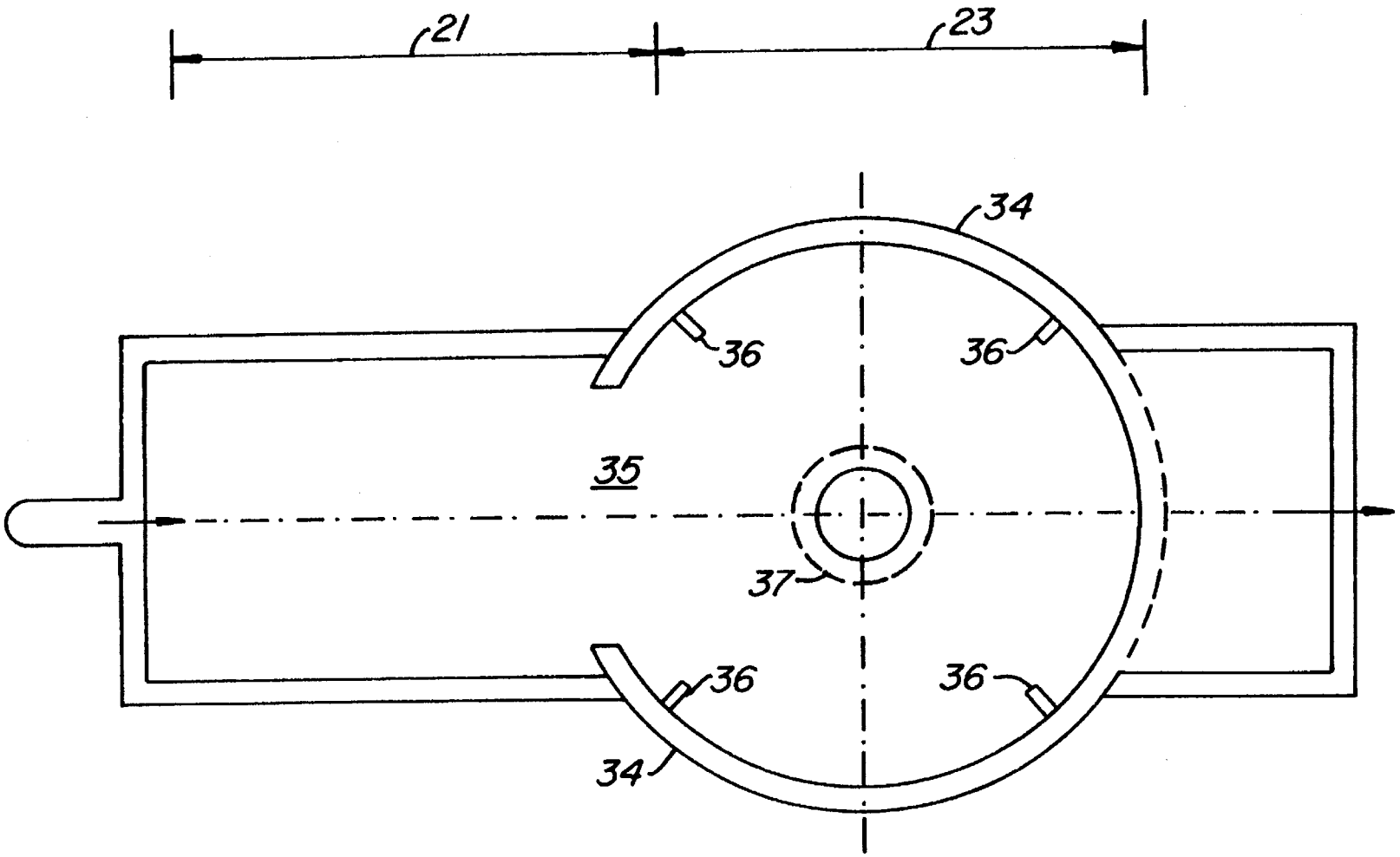
FIG. 4 is a top view of a flotation machine according to the present invention.

When viewed from above, as shown in FIG. 4, the washing zone 21 and the flotation zone 23 have a preferred surface area ratio in the range of approximately 1:3 to 2:3. A surface ratio of 1:2 is most preferred. A communication zone 35 is located between the washing zone 21 and the flotation zone 23. The communication zone 35 allows the flow of water and suspended particles from the washing zone 21 to the flotation zone 23 and has a width that is preferably in the range of one-third to one-half of the width of the flotation zone 23.

Within the settling zone 22, a hydraulic flow pattern is produced; a representation of the flow pattern is shown in FIG. 3. The portion of tank 20 that defines the settling zone 22 is preferably cylindrically shaped, but other configuration may be used, such as an octagonal shape. Centrally positioned in the settling zone 22 is a flow stabilizer 29. The hydrodynamic interactions caused by the washing and flotation zones, and gravity produce a downward spiral flow pattern around the outer regions of the flow stabilizer 29. An optional inlet 28 may be used to introduce additional water, in a tangential direction, into the settling zone 22, thereby contributing to the spiral flow pattern.

In addition, an upward flow pattern or vortexing action is created inside the flow stabilizer 29 due to the interactions with the flotation zone 23. The vortexing action is believed responsible for increasing the recovery of the coal particles that may not have initially floated in the flotation zone 23. The shape of the flow stabilizer 29 can be varied; however, the preferred shape is cylindrical.

The hydraulic flow patterns create a washing effect that further cleans the suspended particles by freeing the coal particles from the heavier pyrite and other mineral particles. The pyrite and other mineral particles eventually settle to form a semistationary solids bed 31 at the bottom of the settling zone 22.

The semistationary bed 31 is employed to further increase the separation of any remaining coal from the pyrite and other mineral solids. Separation is aided by interstitial trickling effects between the particles in the bed. The particles collected on the conical bottom 30 of the settling zone 22 are gradually removed into a pyrite hopper 33. Very fine, non-settling pyrite and mineral matter particles (tailings) are removed with washing water through outlet means 32.

Referring to FIG. 4, the flotation zone 23 of tank 20 is preferably cylindrically shaped. The sidewalls 34 of the flotation zone 23 support baffles 36. The number of baffles 36 used can be varied, however it is preferred that four baffles be used. A flotation impeller assembly 37 is centrally positioned in the flotations zone 23. Various flotation impeller assembly designs may be used. The dimensions of flotation zone 23 are consistent with conventional flotation cell geometries. A froth formed at the top of flotation zone 23 is removed by mechanical means (38), such as skimming.

EXAMPLE

In a series of tests, a hydraulic separator of the present invention, as shown in FIG. 3, was used to further reduce the pyrite and mineral content of a flotation product from a single stage agglomeration based process (i.e., the Aglafloat Batch System described in U.S. Pat. No. 4,966,608). The coal was conditioned and then subject to microagglomeration. The microagglomerates were separated using conventional flotation methods followed by treatment using the present hydraulic separator. The operating conditions of the hydraulic separator were as follows:

1) Impeller speed=1100 rpm
2) Feed rate=5.0 kg/h
3) Wash water flow rate=10–40 kg/h
4) Retention time=~4 min.

The performance of the present hydraulic separator is affected by mass flow rate and assay of the feed into the hydraulic separator. Three bituminous coals were evaluated, Upper Freeport, Ohio and Illinois #6. The results presented in Table 1 provide the average assay values of the tests and show the pyrite and ash contents of the product to be substantially reduced after treatment using the present hydraulic separator. The increase in the percentage of total sulfur removed from the processed coal was in the range of 4–36 percent.

TABLE 1

CLEANING OF COAL IN CONTINUOUS PYRITE SEPARATION UNIT

| Coal | | | Aglofloat Batch System | | | | | Continuous System with Separator | | | | |
|---|---|---|---|---|---|---|---|---|---|---|---|---|
| | Initial Coal | | Product | | | Sulfur Removal | | Product | | | Sulfur Removal | |
| Test | Ash [%] | Total S [%] | Ash [%] | Total S [%] | Pyritic [%] | Total [%] | Pyritic [%] | Ash [%] | Total S [%] | Pyritic [%] | Total [%] | Pyritic [%] |
| UPPER FREEPORT | | | | | | | | | | | | |
| C-11 | 16.5 | 2.27 | 11.8 | 1.64 | 0.90 | 32 | 27 | 8.9 | 1.32 | 0.46 | 47 | 64 |
| C-12 | 16.5 | 2.27 | 11.8 | 1.52 | 0.77 | 36 | 37 | 9.3 | 1.26 | 0.41 | 49 | 68 |
| C-13 | 15.9 | 2.08 | 11.8 | 1.60 | 0.79 | 26 | 43 | 9.8 | 1.33 | 0.53 | 40 | 63 |
| C-14 | 15.9 | 2.08 | 10.5 | 1.42 | 0.50 | 36 | 64 | 9.9 | 1.33 | 0.40 | 40 | 72 |
| C-15 | 15.9 | 2.08 | 10.8 | 1.54 | 0.64 | 30 | 54 | 9.6 | 1.34 | 0.49 | 40 | 65 |
| OHIO | | | | | | | | | | | | |
| C-10 | 9.7 | 4.56 | 7.0 | 3.92 | 2.22 | 16 | 15 | 5.5 | 3.46 | 1.82 | 28 | 32 |
| ILLINOIS NO. 6 | | | | | | | | | | | | |
| D-2 | 32.5 | 5.05 | 14.3 | 4.46 | 2.11 | 27 | 32 | 9.1 | 3.91 | 1.10 | 55 | 75 |
| D-7 | 32.5 | 5.05 | 14.5 | 4.91 | 2.29 | 17 | 31 | 9.5 | 4.09 | 1.30 | 53 | 70 |

The foregoing is considered as illustrative only of the principles of the invention. The present invention can be used with any froth flotation system to improve the quality of the recovered product. For example, the hydraulic separator could be generally used in the mineral processing industry to improve the yields in the froth flotation of chalcopyrite and other minerals. Also, the present hydraulic separator may by used in series such that the product steam from one is treated by a second hydraulic separator and so on. Further, since numerous modifications and changes will readily occur to those skilled in the art, it is not desired to limit the invention to the exact construction and operation shown and described, and accordingly all suitable modifications and equivalents may fall within the scope of the invention.

What is claimed is:

1. A hydraulic separator comprising:

(a) a tank with at least three separate zones, a washing zone, a settling zone and a flotation zone, said washing zone being laterally adjacent to said floatation zone, said settling zone being directly below said flotation zone, said zones being in fluid communication with each other;

(b) said washing zone comprising means for introducing fluid suspended materials into said washing zone and means for washing said suspended materials;

(c) said settling zone comprising a flow stabilizer centrally disposed in said settling zone and a means for removing any settled materials;

(d) said flotation zone comprising an impeller assembly for generating a froth and means for removing said froth.

2. A hydraulic separator according to claim 1 wherein said means for washing comprises spray nozzles that produce high velocity water streams that penetrates said wash zone.

3. A hydraulic separator according to claim 1 wherein said washing zone further comprises a bottom surface having at least a 30° downward slope in the direction of said settling zone.

4. A hydraulic separator according to claim 1 wherein said settling zone further comprises a conical bottom portion.

5. A hydraulic separator according to claim 1 wherein said flotation zone further comprises a chamber with sidewalls and at least one baffle.

6. A hydraulic separator according to claim 5 wherein said washing and flotation zones are connected by a communication zone that has a width in the range of approximately one-third to one-half the width of said chamber of said flotation zone.

7. A hydraulic separator according to claim 6 wherein a top surface area of said washing zone is approximately one-half of a top surface area of said flotation zone.

8. A flotation machine combining three separate operations of washing, settling and flotation in a single unit comprising a washing zone, a settling zone and a flotation zone, said washing zone being laterally adjacent to said flotation zone, said settling zone being directly below and having the same cross section as said flotation zone, said zones being in fluid communication with each other;

said washing zone comprising a three-sided chamber with a bottom surface that slopes downward towards said settling zone, feed means for introducing fluid suspended materials into said wash zone, means for washing said fluid suspended materials, inlet means directing a water stream and said suspended materials towards said flotation and settling zones;

said settling zone comprising a lower portion of a generally cylindrical shaped chamber having a conical bottom portion, a generally cylindrical flow stabilizer that is centrally positioned in said settling zone to permit said suspended materials to flow within and without said flow stabilizer, means for removing a settled portion of said suspended materials, outlet means for removing water;

said flotation zone comprising an upper portion of the generally cylindrical chamber having side walls, at least one baffle attached to said side walls, an impeller assembly for producing a froth and means for removing said froth.

* * * * *

UNITED STATES PATENT AND TRADEMARK OFFICE

CERTIFICATE OF CORRECTION

PATENT NO. : 5,472,094

DATED : December 5, 1995

INVENTOR(S) : Szymocha et al.

It is certified that error appears in the above-indentified patent and that said Letters Patent is hereby corrected as shown below:

Column 3, line 41, change "according the" to read --according to the--.
Column 4, line 32, change "flotations zone" to read --flotation zone--.
Column 4, line 55, change "= ~4" to read --= ~4--.

Signed and Sealed this

Eleventh Day of November, 1997

Bruce Lehman

*Attest:*

BRUCE LEHMAN

*Attesting Officer*

*Commissioner of Patents and Trademarks*